US007905565B2

(12) United States Patent
Kitabatake et al.

(10) Patent No.: US 7,905,565 B2
(45) **Date of Patent: *Mar. 15, 2011**

(54) RECORDING APPARATUS AND METHOD FOR DETECTING THE POSITION OF AN INK CONTAINER

(75) Inventors: Kenji Kitabatake, Kawasaki (JP); Yasuhiko Ikeda, Sagamihara (JP); Mitsuyuki Fujibayashi, Kawasaki (JP); Takayuki Ochiai, Inagi (JP); Akira Kuribayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

This patent is subject to a terminal disclaimer.

(21) Appl. No.: 11/424,954

(22) Filed: Jun. 19, 2006

(65) Prior Publication Data

US 2006/0284919 A1 Dec. 21, 2006

(30) Foreign Application Priority Data

Jun. 21, 2005 (JP) ..... 2005-180555

(51) Int. Cl.
*B41J 29/393* (2006.01)

(52) U.S. Cl. ..... 347/19; 347/5; 347/9

(58) Field of Classification Search ..... 347/5, 9, 347/12, 19, 86, 7, 14
See application file for complete search history.

(56) References Cited

U.S. PATENT DOCUMENTS

| | | | | |
|---|---|---|---|---|
| 5,841,448 | A | 11/1998 | Moriyama et al. | |
| 2002/0070985 | A1 | 6/2002 | Takagi | |
| 2005/0219303 | A1 * | 10/2005 | Matsumoto et al. | 347/19 |

FOREIGN PATENT DOCUMENTS

| | | | |
|---|---|---|---|
| JP | 11-138842 | A | 5/1999 |
| JP | 2002-052781 | A | 2/2002 |
| JP | 2003-063013 | A | 3/2003 |

* cited by examiner

*Primary Examiner* — Lam S Nguyen
(74) *Attorney, Agent, or Firm* — Canon U.S.A., Inc., IP Division

(57) ABSTRACT

A recording apparatus and method for detecting the position of an ink container in the recording apparatus, whereby when an ink tank is correctly mounted within the recording apparatus, detection of the position of the ink container is performed in a timely manner, and whereby when in container is incorrectly mounted, the incorrect position as well as the color of the incorrectly mounted ink container are identified using light emitting portions of the ink containers.

13 Claims, 18 Drawing Sheets

→ POSITION

| LIGHT EMISSION TANK ↓ | K | C | M | Y |
|---|---|---|---|---|
| K | 563 | | | |
| C | | | | |
| M | | | | |
| Y | | | | |

→ POSITION

| LIGHT EMISSION TANK ↓ | K | C | M | Y |
|---|---|---|---|---|
| K | 563 | 110 | | |
| C | | | | |
| M | | | | |
| Y | | | | |

→ POSITION

| LIGHT EMISSION TANK ↓ | K | C | M | Y |
|---|---|---|---|---|
| K | 563 | 110 | 28 | |
| C | | | | |
| M | | | | |
| Y | | | | |

→ POSITION

| LIGHT EMISSION TANK ↓ | K | C | M | Y |
|---|---|---|---|---|
| K | 563 | 110 | 28 | 3 |
| C | | | | |
| M | | | | |
| Y | | | | |

→ POSITION

LIGHT EMISSION TANK ↓

| | K | C | M | Y |
|---|---|---|---|---|
| K | 563 | 220 | 28 | 3 |
| C | | | | 1 |
| M | | | | |
| Y | | | | |

→ POSITION

LIGHT EMISSION TANK ↓

| | K | C | M | Y |
|---|---|---|---|---|
| K | 563 | 110 | 28 | 3 |
| C | | | 13 | 1 |
| M | | | | |
| Y | | | | |

→ POSITION

LIGHT EMISSION TANK ↓

| | K | C | M | Y |
|---|---|---|---|---|
| K | 563 | 110 | 28 | 3 |
| C | | 62 | 13 | 1 |
| M | | | | |
| Y | | | | |

→ POSITION

LIGHT EMISSION TANK ↓

| | K | C | M | Y |
|---|---|---|---|---|
| K | 563 | 110 | 28 | 3 |
| C | 14 | 62 | 13 | 1 |
| M | | | | |
| Y | | | | |

→ POSITION

LIGHT EMISSION TANK ↓

| | K | C | M | Y |
|---|---|---|---|---|
| K | 563 | 110 | 28 | 3 |
| C | 14 | 62 | 13 | 1 |
| M | 3 | | | |
| Y | | | | |

→ POSITION

LIGHT EMISSION TANK ↓

| | K | C | M | Y |
|---|---|---|---|---|
| K | 563 | 110 | 28 | 3 |
| C | 14 | 62 | 13 | 1 |
| M | 3 | 67 | | |
| Y | | | | |

→ POSITION

LIGHT EMISSION TANK ↓

| | K | C | M | Y |
|---|---|---|---|---|
| K | 563 | 110 | 28 | 3 |
| C | 14 | 62 | 13 | 1 |
| M | 3 | 67 | 323 | |
| Y | | | | |

→ POSITION

LIGHT EMISSION TANK ↓

| | K | C | M | Y |
|---|---|---|---|---|
| K | 563 | 110 | 28 | 3 |
| C | 14 | 62 | 13 | 1 |
| M | 3 | 67 | 323 | 68 |
| Y | | | | |

→ POSITION

LIGHT EMISSION TANK ↓

| | K | C | M | Y |
|---|---|---|---|---|
| K | 563 | 110 | 28 | 3 |
| C | 14 | 62 | 13 | 1 |
| M | 3 | 67 | 323 | 68 |
| Y | | | | 663 |

→ POSITION

LIGHT EMISSION TANK ↓

| | K | C | M | Y |
|---|---|---|---|---|
| K | 563 | 110 | 28 | 3 |
| C | 14 | 62 | 13 | 1 |
| M | 3 | 67 | 323 | 68 |
| Y | | | 146 | 663 |

→ POSITION

LIGHT EMISSION TANK ↓

| | K | C | M | Y |
|---|---|---|---|---|
| K | 563 | 110 | 28 | 3 |
| C | 14 | 62 | 13 | 1 |
| M | 3 | 67 | 323 | 68 |
| Y | | 30 | 146 | 663 |

→ POSITION

LIGHT EMISSION TANK ↓

| | K | C | M | Y |
|---|---|---|---|---|
| K | 563 | 110 | 28 | 3 |
| C | 14 | 62 | 13 | 1 |
| M | 3 | 67 | 323 | 68 |
| Y | 6 | 30 | 146 | 663 |

POSITION

| LIGHT EMISSION TANK | K | C | M | Y |
|---|---|---|---|---|
| K | 563 | | | |
| C | | | | |
| M | | | | |
| Y | | | | |

POSITION

| LIGHT EMISSION TANK | K | C | M | Y |
|---|---|---|---|---|
| K | 563 | 110 | | |
| C | | | | |
| M | | | | |
| Y | | | | |

POSITION

| LIGHT EMISSION TANK | K | C | M | Y |
|---|---|---|---|---|
| K | 563 | 110 | 28 | |
| C | | | | |
| M | | | | |
| Y | | | | |

POSITION

| LIGHT EMISSION TANK | K | C | M | Y |
|---|---|---|---|---|
| K | 563 | 110 | 28 | 3 |
| C | | | | |
| M | | | | |
| Y | | | | |

→ POSITION

LIGHT EMISSION TANK ↓

| | K | C | M | Y |
|---|---|---|---|---|
| K | 563 | 220 | 28 | 3 |
| C | | | | 13 |
| M | | | | |
| Y | | | | |

→ POSITION

LIGHT EMISSION TANK ↓

| | K | C | M | Y |
|---|---|---|---|---|
| K | 563 | 110 | 28 | 3 |
| C | | | 62 | 13 |
| M | | | | |
| Y | | | | |

→ POSITION

LIGHT EMISSION TANK ↓

| | K | C | M | Y |
|---|---|---|---|---|
| K | 563 | 110 | 28 | 3 |
| C | | 14 | 62 | 13 |
| M | | | | |
| Y | | | | |

→ POSITION

LIGHT EMISSION TANK ↓

| | K | C | M | Y |
|---|---|---|---|---|
| K | 563 | 110 | 28 | 3 |
| C | 1 | 14 | 62 | 13 |
| M | | | | |
| Y | | | | |

→ POSITION

LIGHT EMISSION TANK ↓

| | K | C | M | Y |
|---|---|---|---|---|
| K | 563 | 110 | 28 | 3 |
| C | 1 | 14 | 62 | 13 |
| M | 67 | | | |
| Y | | | | |

→ POSITION

LIGHT EMISSION TANK ↓

| | K | C | M | Y |
|---|---|---|---|---|
| K | 563 | 110 | 28 | 3 |
| C | 1 | 14 | 62 | 13 |
| M | 67 | 323 | | |
| Y | | | | |

→ POSITION

LIGHT EMISSION TANK ↓

| | K | C | M | Y |
|---|---|---|---|---|
| K | 563 | 110 | 28 | 3 |
| C | 1 | 14 | 62 | 13 |
| M | 67 | 323 | 68 | |
| Y | | | | |

→ POSITION

LIGHT EMISSION TANK ↓

| | K | C | M | Y |
|---|---|---|---|---|
| K | 563 | 110 | 28 | 3 |
| C | 1 | 14 | 62 | 13 |
| M | 67 | 323 | 68 | 3 |
| Y | | | | |

→ POSITION

LIGHT EMISSION TANK ↓

| | K | C | M | Y |
|---|---|---|---|---|
| K | 563 | 110 | 28 | 3 |
| C | 1 | 14 | 62 | 13 |
| M | 67 | 323 | 68 | 3 |
| Y | | | | 663 |

→ POSITION

LIGHT EMISSION TANK ↓

| | K | C | M | Y |
|---|---|---|---|---|
| K | 563 | 110 | 28 | 3 |
| C | 1 | 14 | 62 | 13 |
| M | 67 | 323 | 68 | 3 |
| Y | | | 146 | 663 |

→ POSITION

LIGHT EMISSION TANK ↓

| | K | C | M | Y |
|---|---|---|---|---|
| K | 563 | 110 | 28 | 3 |
| C | 1 | 14 | 62 | 13 |
| M | 67 | 323 | 68 | 3 |
| Y | | 30 | 146 | 663 |

→ POSITION

LIGHT EMISSION TANK ↓

| | K | C | M | Y |
|---|---|---|---|---|
| K | 563 | 110 | 28 | 3 |
| C | 1 | 14 | 62 | 13 |
| M | 67 | 323 | 68 | 3 |
| Y | 6 | 30 | 146 | 663 |

→ POSITION

| LIGHT EMISSION TANK ↓ | K | C | M | Y |
|---|---|---|---|---|
| K | 563 | | | |
| C | 14 | 62 | | |
| M | | | | |
| Y | | | | |

→ POSITION

| LIGHT EMISSION TANK ↓ | K | C | M | Y |
|---|---|---|---|---|
| K | 563 | 110 | | |
| C | 14 | 62 | | |
| M | | | | |
| Y | | | | |

→ POSITION

| LIGHT EMISSION TANK ↓ | K | C | M | Y |
|---|---|---|---|---|
| K | 563 | 110 | | |
| C | 14 | 62 | | |
| M | | 67 | | |
| Y | | | | |

→ POSITION

LIGHT EMISSION TANK ↓

| | K | C | M | Y |
|---|---|---|---|---|
| K | 563 | 110 | | |
| C | 14 | 62 | | |
| M | | 67 | 323 | |
| Y | | | | |

→ POSITION

LIGHT EMISSION TANK ↓

| | K | C | M | Y |
|---|---|---|---|---|
| K | 563 | 110 | | |
| C | 14 | 62 | 13 | |
| M | | 67 | 323 | |
| Y | | | | |

→ POSITION

LIGHT EMISSION TANK ↓

| | K | C | M | Y |
|---|---|---|---|---|
| K | 563 | 110 | | |
| C | 14 | 62 | 13 | |
| M | | 67 | 323 | |
| Y | | | 146 | |

→ POSITION

LIGHT EMISSION TANK ↓

| | K | C | M | Y |
|---|---|---|---|---|
| K | 563 | 110 | | |
| C | 14 | 62 | 13 | |
| M | | 67 | 323 | |
| Y | | | 146 | 663 |

→ POSITION

LIGHT EMISSION TANK ↓

| | K | C | M | Y |
|---|---|---|---|---|
| K | 563 | 110 | | |
| C | 14 | 62 | 13 | |
| M | | 67 | 323 | 68 |
| Y | | | 146 | 663 |

→ POSITION

LIGHT EMISSION TANK ↓

| | K | C | M | Y |
|---|---|---|---|---|
| K | 563 | | | |
| C | | | | |
| M | | | | |
| Y | | | | |

→ POSITION

LIGHT EMISSION TANK ↓

| | K | C | M | Y |
|---|---|---|---|---|
| K | 563 | | | |
| C | 1 | | | |
| M | | | | |
| Y | | | | |

→ POSITION

LIGHT EMISSION TANK ↓

| | K | C | M | Y |
|---|---|---|---|---|
| K | 563 | | | |
| C | 1 | 14 | | |
| M | | | | |
| Y | | | | |

→ POSITION

LIGHT EMISSION TANK ↓

| | K | C | M | Y |
|---|---|---|---|---|
| K | 563 | 110 | | |
| C | 1 | 14 | | |
| M | | | | |
| Y | | | | |

→ POSITION

LIGHT EMISSION TANK ↓

| | K | C | M | Y |
|---|---|---|---|---|
| K | 563 | 110 | | |
| C | 1 | 14 | | |
| M | | 323 | | |
| Y | | | | |

→ POSITION

LIGHT EMISSION TANK ↓

| | K | C | M | Y |
|---|---|---|---|---|
| K | 563 | 110 | | |
| C | 1 | 14 | | |
| M | | 323 | 68 | |
| Y | | | | |

→ POSITION

LIGHT EMISSION TANK ↓

| | K | C | M | Y |
|---|---|---|---|---|
| K | 563 | 110 | | |
| C | 1 | 14 | 62 | |
| M | | 323 | 68 | |
| Y | | | | |

→ POSITION

LIGHT EMISSION TANK ↓

| | K | C | M | Y |
|---|---|---|---|---|
| K | 563 | 110 | | |
| C | 1 | 14 | 62 | |
| M | | 323 | 68 | |
| Y | | | 146 | |

→ POSITION

LIGHT EMISSION TANK ↓

| | K | C | M | Y |
|---|---|---|---|---|
| K | 563 | 110 | | |
| C | 1 | 14 | 62 | |
| M | | 323 | 68 | |
| Y | | | 146 | 663 |

→ POSITION

LIGHT EMISSION TANK ↓

| | K | C | M | Y |
|---|---|---|---|---|
| K | 563 | 110 | | |
| C | 1 | 14 | 62 | |
| M | | 323 | 68 | 3 |
| Y | | | 146 | 663 |

RECORDING APPARATUS AND METHOD FOR DETECTING THE POSITION OF AN INK CONTAINER

CROSS-REFERENCE TO RELATED APPLICATIONS

This application is related to the following applications, all of which are filed on the same day and assigned to the same assignee as the present application:

"Recording Apparatus for Detecting Position of Ink Tank and Position Detecting Method of the Ink Tank" U.S. application Ser. No. 11/424,944

"Recording Apparatus Capable of Checking Positions of Ink Containers, and Method for Checking the Positions" U.S. application Ser. No. 11/424,950

"Ink Tank Position Detection Method" U.S. application Ser. No. 11/424,940

BACKGROUND OF THE INVENTION

1. Field of the Invention

This invention relates to a position checking method, and more particularly to a position checking method in which the mounting positions of ink tanks are specified in a recording apparatus.

2. Related Background Art

According to recent demands for further improve image quality, not only four popular color inks (black, yellow, magenta, and cyan), but also a light magenta ink and a light cyan ink having low density have been used. Further, the use of so-called special color inks such as red ink and blue ink has also been proposed. When these inks are used, seven or eight ink tanks corresponding to the colors are individually mounted in an inkjet printer. In this case, a mechanism is necessary to prevent the ink tanks from being mounted at wrong positions. Japanese Patent Laid-Open No. 2001-253087 discloses that the engaged portions between a carriage and ink tanks have different shapes. This prevents the ink tanks from being mounted improperly.

In order to specify the mounting positions of the ink tanks, the engaged portions between the carriage and the ink tanks have different shapes, as described above. In this case, however, it is necessary to produce ink tanks that have different shapes corresponding to the colors and types of ink. This is disadvantageous in terms of production efficiency and cost.

As another method, it is conceivable to separately provide different circuit signal lines of circuits, which are formed by connecting electrical contacts of ink tanks and electrical contacts provided at the mounting positions of the ink tanks in a carriage of a main unit, corresponding to the mounting positions. For example, it is conceivable to respectively provide different signal lines corresponding to the mounting positions in order to read ink color information from the ink tanks, and to control lighting of LEDs. When the color information read from any of the ink tanks does not correspond to the mounting position, it is determined that the ink tank is mounted improperly.

However, when the signal lines are thus separately provided corresponding to the ink tanks or the mounting positions, the number of signal lines increases. In particular, there is a tendency to improve image quality by increasing the number of types of inks in recent inkjet printers, as described above. In these printers, particularly, the increase in the number of signal lines increases the cost. A so-called bus connection using a common signal line is effective in reducing the number of signal lines. However, it is apparent that the ink tank or the mounting position of the ink tank cannot be determined by simply using a common signal line like a bus connection.

Accordingly, a position checking method is conceivable in which lighting of LEDs at mounting positions of a plurality of ink tanks is controlled by a common signal line, and in which the mounting positions of the ink tanks can be determined. However, the amount of emitted light varies among the LEDs, and therefore, the amount of light received by a light receiver provided in the printer also varies. For this reason, it is sometimes difficult to check the presence or absence of emitted light with reference to a threshold value depending on the amount of received light, and to thereby check the positions of the ink tanks. Although this problem can be solved by reducing the variation in the amount of emitted light, the cost is increased, for example, because there is a need to screen LEDs.

SUMMARY OF THE INVENTION

The present invention is directed to a position checking method that can specify mounting positions of liquid containers, such as ink tanks.

According to an aspect of the present invention, a recording apparatus includes a carriage, a plurality of ink containers detachably mounted in the carriage and having respective light emitting portions, a light receiving portion configured to receive light from the light emitting portions, where the position of the plurality of ink containers are determined based on the light that is emitted from the light emitting portions and received by the light receiving portion.

DESCRIPTION OF THE EXEMPLARY EMBODIMENTS

First Embodiment

Figure 17:
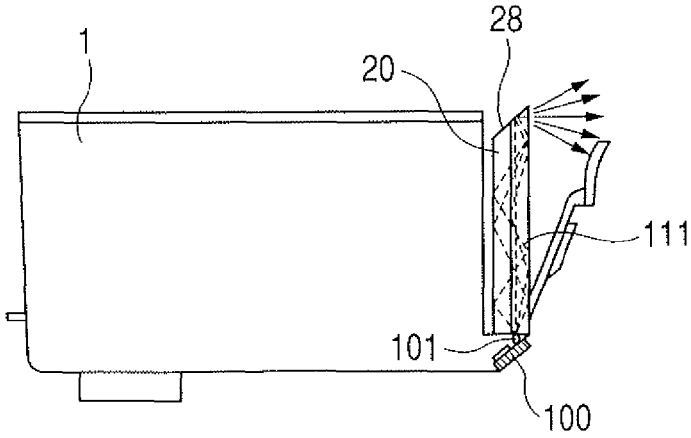
FIG. 17 is a side view of an ink tank according to an embodiment of the present invention.

FIG. 17 is a side view showing a form of an ink tank according to a first exemplary embodiment of the present invention. A substrate 100 having an LED 101 mounted thereon is carried on an ink tank 1. Light emitted from the LED 101 is guided in a light guide 20, is reflected by an inclined portion 28, and is emitted toward the right side of the ink tank 1 in FIG. 17, thus forming an optical path 111.

Figure 18:
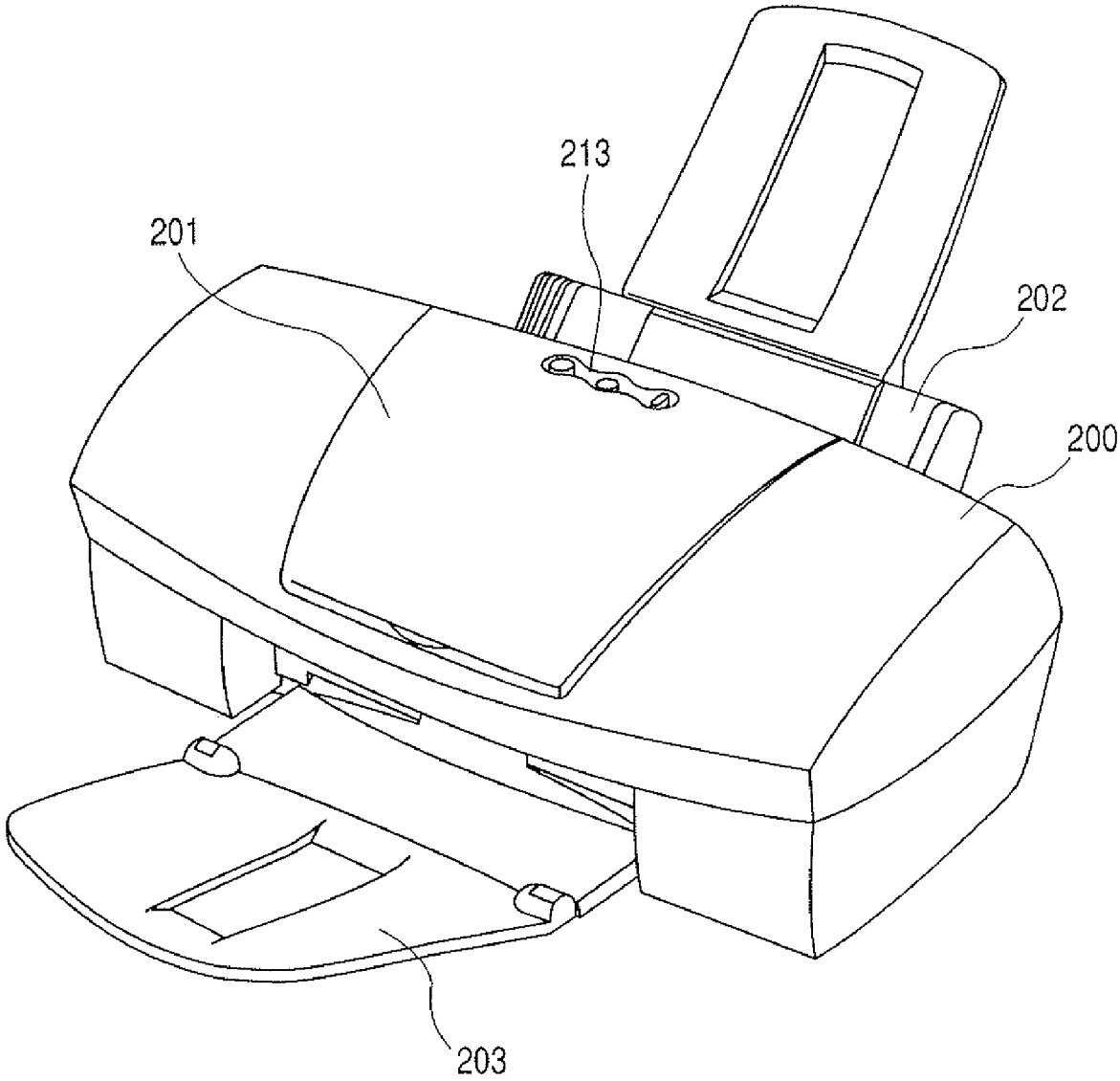
FIG. 18 is a perspective view of an ink jet printer which effects recording with the ink tank mounted therein.
Figure 19:
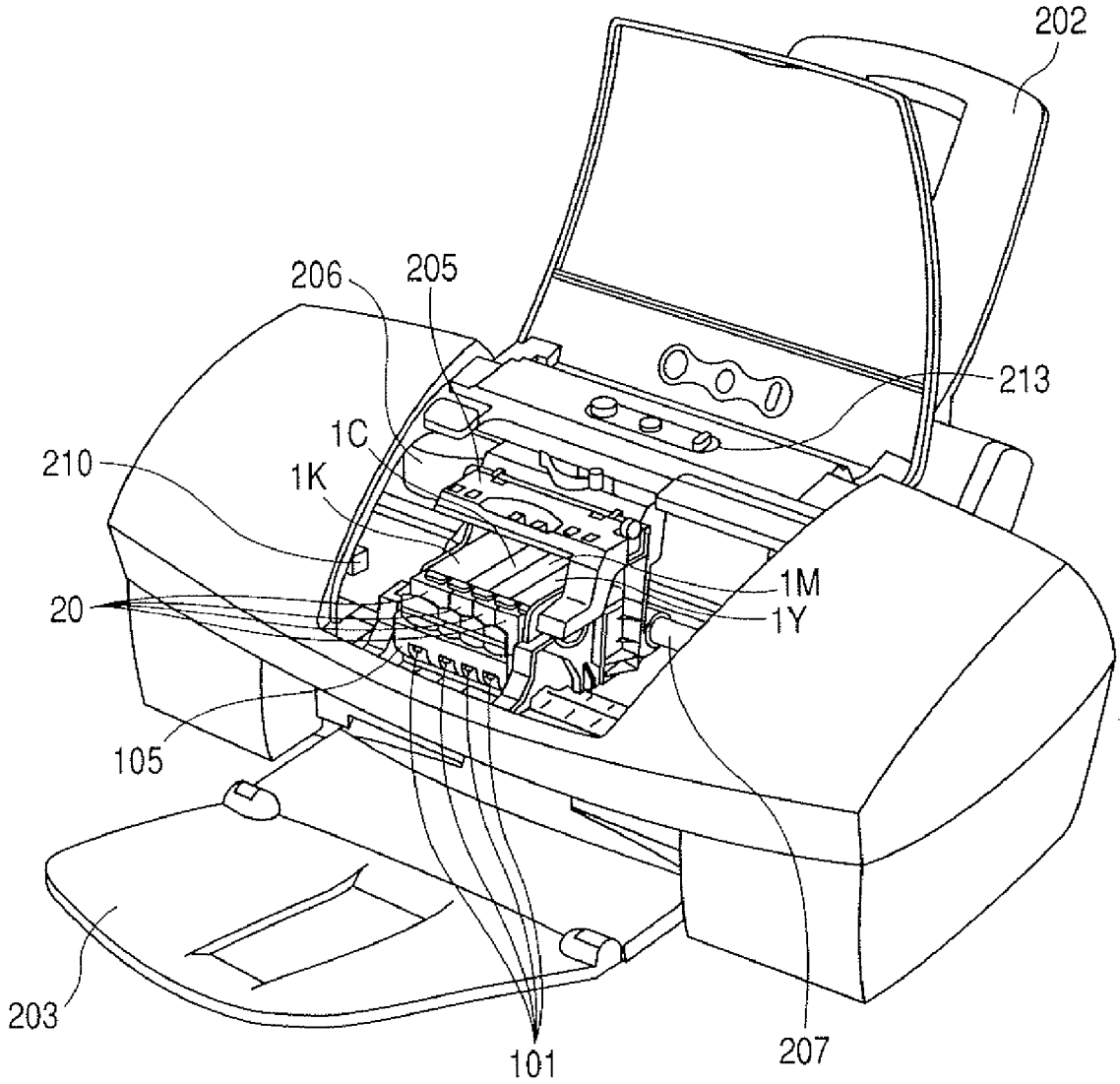
FIG. 19 is a perspective view of the ink jet printer with a main body cover shown in FIG. 18 detached therefrom.

FIG. 18 depicts an ink jet printer 200 which effects recording with the above-described ink tank 1 mounted therein, while FIG. 19 is a perspective view showing a state in which a main body cover 201 shown in FIG. 18 has been opened.

As shown in FIG. 18, a main part of the inkjet printer 200 is formed by a mechanism that performs recording by scanning a carriage 205 (FIG. 19) on which recording heads and ink tanks are mounted. The main part is covered with the main body cover 201 and other case portion, sheet discharge trays 203 provided before and behind it, and an automatic sheet feeder (ASF) 202. The inkjet printer 200 also includes an operating unit 213 having a display that indicates the condition of the inkjet printer 200 in both a state in which the main body cover 201 is closed and a state in which the main body cover 201 is opened, a power supply switch and a reset switch.

In the state in which the main cover 201 is opened, as shown in FIG. 19, a user can see a range in which the carriage 205 carrying a recording head unit 105 and ink tanks 1K, 1C, 1M and 1Y (hereinafter these ink tanks are sometimes by the same reference numeral "1") mounted thereon moves, and the surroundings of the range. In actuality, when the main cover 201 is opened, a sequence in which the carriage 205 is automatically moved to almost the center position (hereinafter referred to as the "tank interchanging position") shown in FIG. 19 is performed. The user can replace each tank at the tank interchanging position.

The recording head unit 105 includes chip-shaped recording heads (not shown) corresponding to the ink of each color in the recording head unit 105. The recording heads are scanned over a recording medium, such as a sheet of paper, by the movement of the carriage 205, and discharge ink onto the recording medium during the scanning operation to thereby affect recording. That is, the carriage 205 is slidably engaged with a guide shaft 207 that extends in the movement direction thereof and can be moved by a carriage motor and a mechanism for transmitting the driving force from the carriage motor. Therefore, respective recording heads corresponding to K, C, M and Y color inks effect ink discharge on the basis of discharge data sent from a control circuit on a main body side via a flexible cable 206. A sheet feeding mechanism, including a sheet feeding roller and an ejection roller, is also provided to convey a recording medium (not shown) supplied from the automatic sheet feeder 202 onto the ejection tray 203. The recording head unit 105, with which ink tank holders are integrally provided, is detachably mounted on the carriage 205. The ink tanks 1 are detachably mounted with respect to the recording head unit 105.

During recording, each of the recording heads is scanned while discharging ink onto the recording medium to record in a region having a width corresponding to discharge openings of the recording head. Also, the recording medium is conveyed by a predetermined amount corresponding to the above-described width by the sheet feeding mechanism between scanning operations, so that recording on the recording medium is performed sequentially. A discharging recovery unit, such as a cap, is provided at an end of the range, in which the recording heads are moved by the movement of the carriage 205, to cover surfaces of the recording heads on which the discharge openings are provided. The recording heads are moved to the recovery unit at predetermined time intervals so as to be subjected to recovery operation such as preliminary discharging.

The recording head unit 105 provided with the tank holders for the ink tanks 1 has connectors corresponding the ink tanks 1, as described above. Each of the connectors is in contact with a pad of the substrate provided on the corresponding ink tank 1. This allows control of turning on or turning off of each LED 101.

More specifically, at the above-described tank interchanging position, when the amount of ink remaining in each ink tank 1 becomes low, the LED 101 corresponding to the ink tank 1 is turned on or turned off. In this case, the user can observe light guided from the LED 101 in the light guide 20 by viewing the ink tank 1 from above the ink jet printer 200.

A light receiving portion 210 having a light receiving element is provided near the end portion of the movement range of the carriage which is opposite the position at which the above-described recording unit is provided. Thus, when the LED 101 of each ink tank 1 passes the light receiving portion 210 during the movement of the carriage 205, the LED 101 of each ink tank 1 is turned on (i.e., emits light), and the light emitted by the LED 101 is received by the light receiving portion 210. Based on the position of the carriage 205 when the light is received, the position of each ink tank 1 on the carriage 205 can be detected. Further, as another example of controlling lighting (i.e., turning on) of the LED 101, when the ink tank 1 has been properly mounted at the tank interchanging position, the control of turning on the LED 101 of that tank is affected. This control, like the control of ink discharge by the recording heads, is executed according to control data (control signal) transmitted from a control circuit on the main body side to each ink tank through the flexible cable 206.

Figure 20:
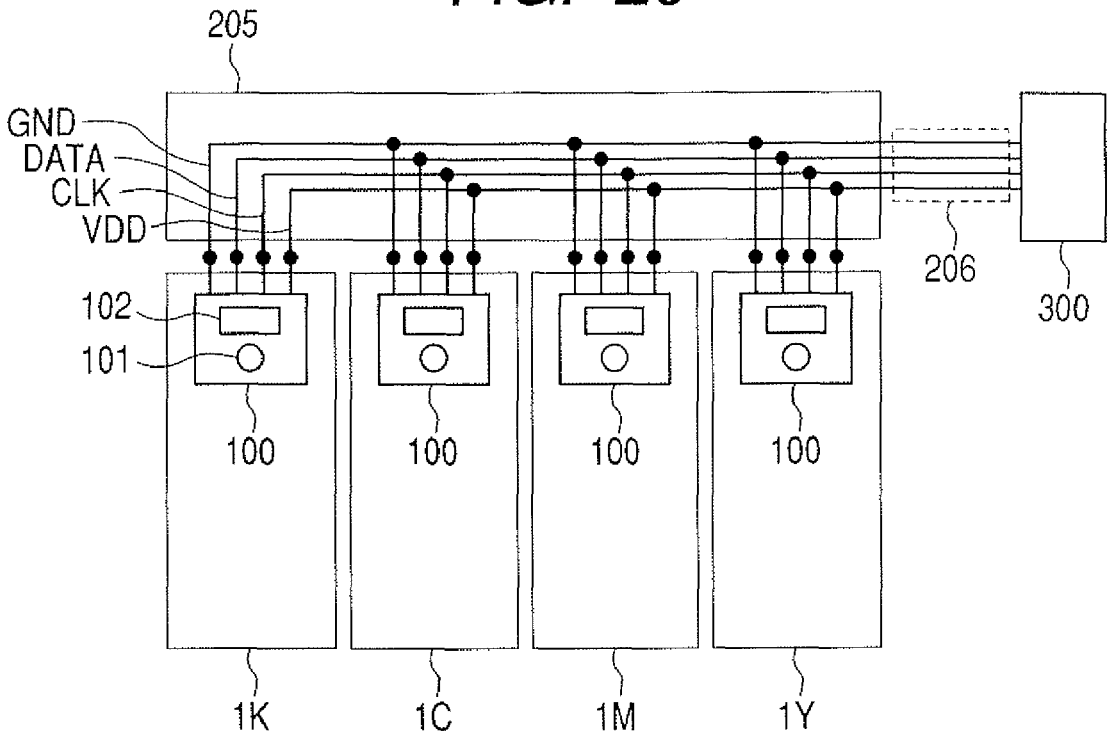
FIG. 20 is a conceptual view showing signal lines for connection between the inkjet printer and the ink tanks in conjunction with substrates of the ink tanks.

FIG. 20 shows a wiring structure in the flexible cable 206 for connecting the ink tanks 1 and a control circuit 300 in conjunction with substrates 100 of the ink tanks 1.

As shown in FIG. 20, the wiring structure for the four ink tanks 1 is comprised of four signal lines, and is common to the four ink tanks 1 (so-called bus connection). That is, a wiring structure for each respective ink tank 1 comprises four signal lines, i.e., a power supply signal line "VDD", a ground signal line "GND", a signal line "DATA", and a clock signal line "CLK". The power signal line VDD is concerned with the supply of power for the operation of a function element in an IC package 102 that lights and drives the LED 101 in the ink tank 1. The signal line DATA transmits control signals (control data) relating operations, such as lighting and flashing of the LED 101, from the control circuit 300, as will be described below. While the four signal lines are used in the present exemplary embodiment, the present invention is not limited thereto. For example, the ground signal line "GND" may be omitted by obtaining a ground signal by other methods. It is also possible to combine the signal lines "CLK" and "DATA". In this case, it is not necessary to provide a signal line "DATA" for each ink tank 1, and it is possible to reduce the signal wiring in the flexible cable 206. For example, when a signal line DATA is provided for each of eight color ink tanks in the printer, eleven lines, that is, eight signal lines DATA, a power signal line VDD, a ground signal line GND, and a clock signal line CLK are necessary. This complicates the wiring structure of the flexible cable 206, and increases the cost. For this reason, the above-described bus connection provides a cost advantage to the printer in which a plurality of color ink tanks are mounted.

The control circuit 300 performs data processing and operation control in the printer 200. For that purpose, the control circuit 300 includes a CPU, a ROM that stores a program for operation control, and a RAM serving as a work area, although they are not shown.

Figure 21:
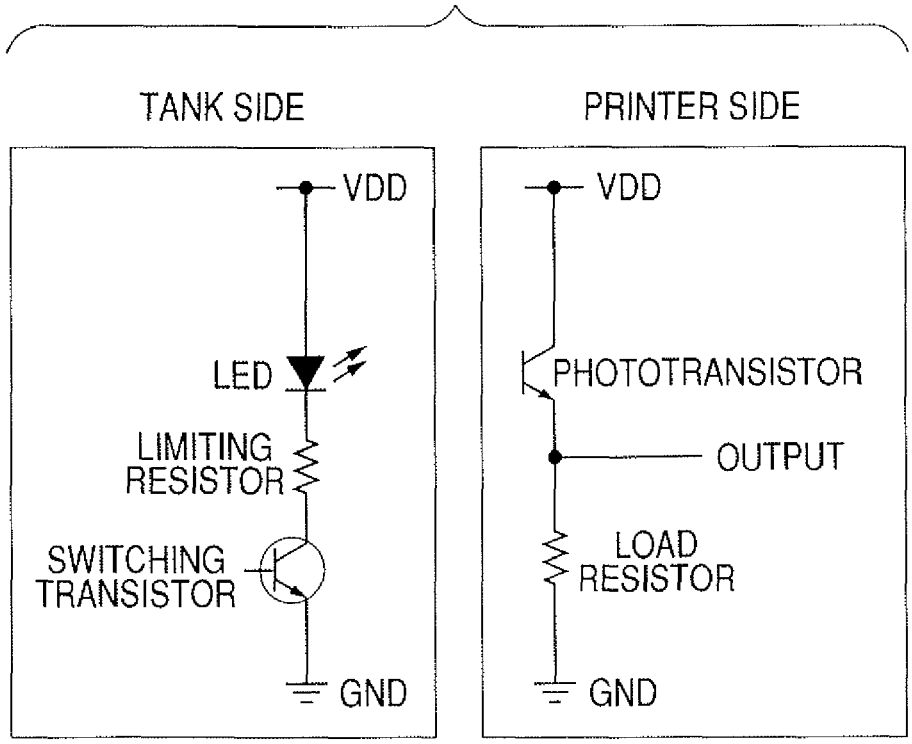
FIG. 21 is a circuit diagram showing the configurations of a light emitting circuit of the ink tank and a light receiving circuit of a light receiving portion.

FIGS. 1A to 1D to FIGS. 4A to 4D are schematic views showing a position checking procedure according to the first exemplary embodiment of the present invention. The steps shown in FIGS. 1A to 4C are performed sequentially. The carriage 205 is movable along the guide shaft 207, and includes four positions, namely, a black position K, a cyan position C, a magenta position M, and a yellow position Y arranged in that order from the left side. The black ink tank 1K, the cyan ink tank 1C, the magenta ink tank 1M, and the yellow ink tank 1Y are respectively mounted at the black position K, the cyan position C, the magenta position M, and the yellow position Y. The light receiver 210 is fixed on the main unit (not shown) of the printer 200. The light receiver 210 is a sensor which can be formed of a phototransistor, and a photocurrent varies depending on the amount of light received by the light receiver 210. In the present embodiment, a circuit shown in FIG. 21 detects the change in the photocurrent as a voltage change when an output potential of VDD=3300 mV and load resistance=150 kΩ is used as the reference potential. That is, the amount of received light is expressed as the voltage. FIGS. 1A to 4D show a state in which the ink tanks 1 are properly mounted at correct positions in the carriage 205. Light emission of the light emitting element, detection of a photocurrent in accordance with the amount of received light, movement of the carriage 205, the checking of the ink tank 1 positions, which will be described below, are controlled according to the program stored in the ROM in the control circuit 300.

Figure 1A:
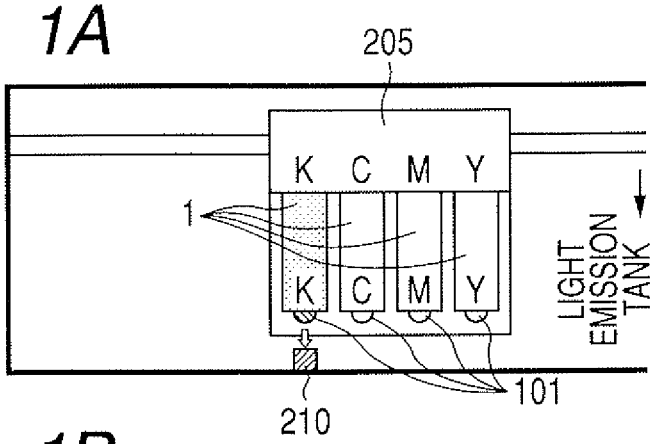
FIGS. 1A, 1B, 1C and 1D are schematic views showing a position checking procedure according to a first embodiment of the present invention.
Figure 1B:
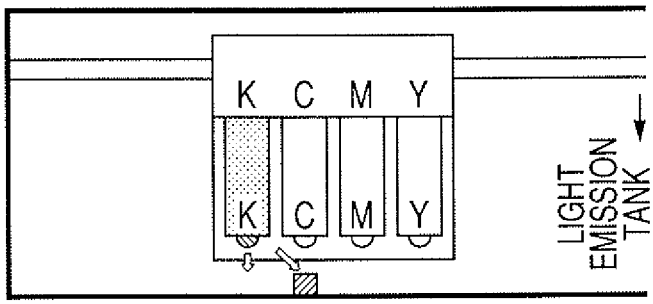

In FIGS. 1A to 1D, the LED 101 of the black ink tank 1K is first turned on. FIG. 1A shows a position in which the light receiving portion 210 faces the black ink tank 1K. In this case, the amount of light received by the light receiving portion 210 is 563 mV. Next, FIG. 1B shows a state in which the carriage 205 has been moved along the guide shaft 207 to the left by a distance corresponding to an ink tank, and the light receiving portion 210 faces the cyan ink tank 1C. In this case, since the LED 101 of the black ink tank 1K is turned on, the amount of light that reaches the light receiving portion 210 is 110 mV, which is less than when the light receiving portion 210 faces the black ink tank 1K.

Figure 1C:
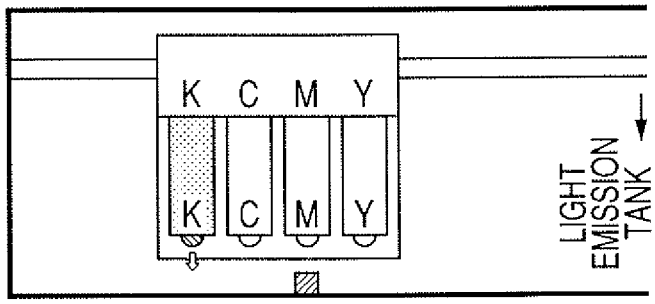
Figure 1D:
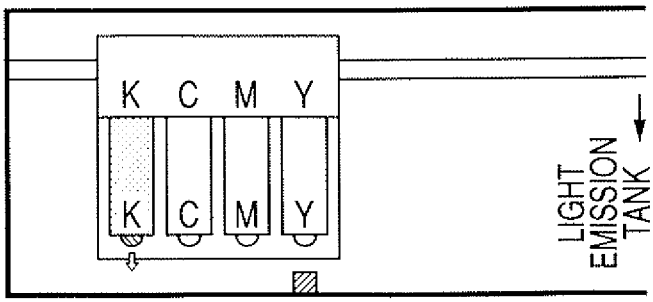
Figure 2A:
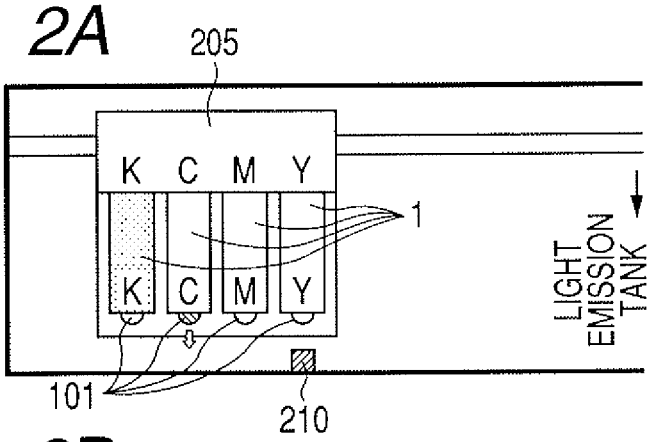
FIGS. 2A, 2B, 2C and 2D are schematic views showing the position checking procedure according to the first embodiment of the present invention.
Figure 2B:
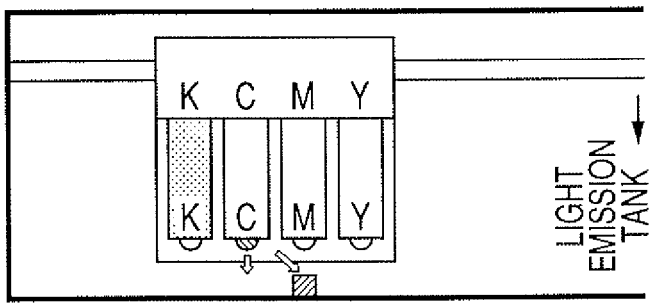
Figure 2C:
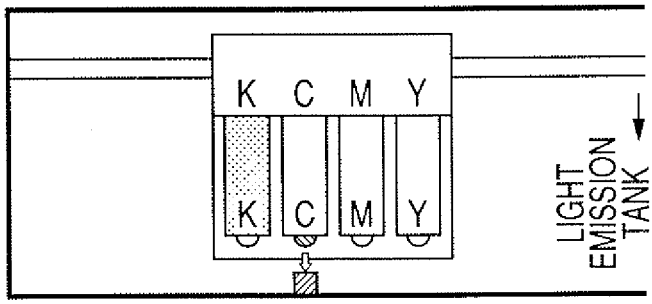
Figure 2D:
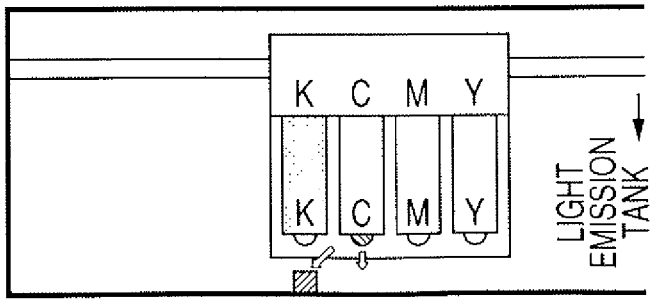
Figure 3A:
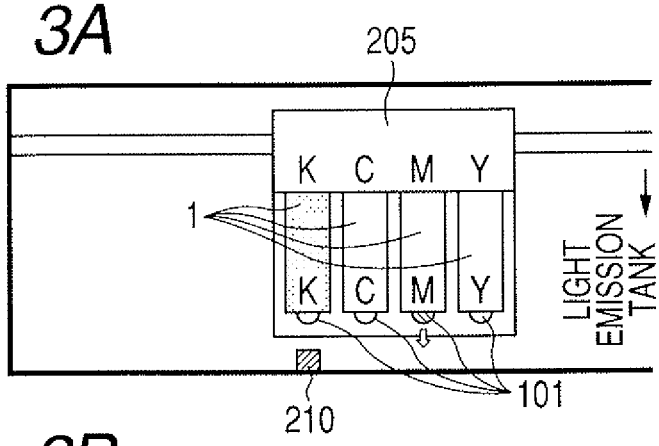
FIGS. 3A, 3B, 3C and 3D are schematic views showing the position detecting procedure according to the first embodiment of the present invention.
Figure 3B:
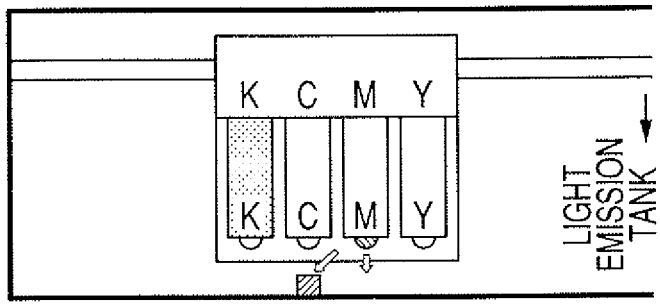
Figure 3C:
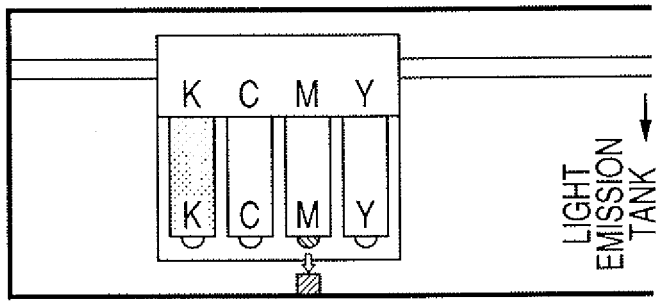
Figure 3D:
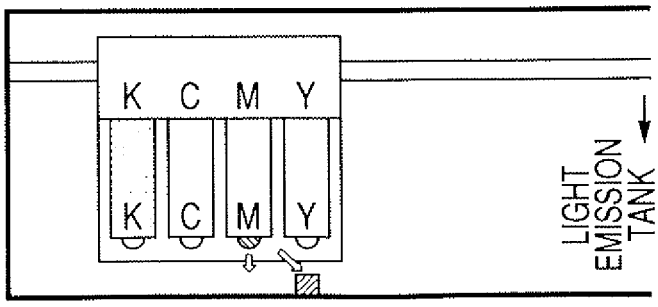
Figure 4A:
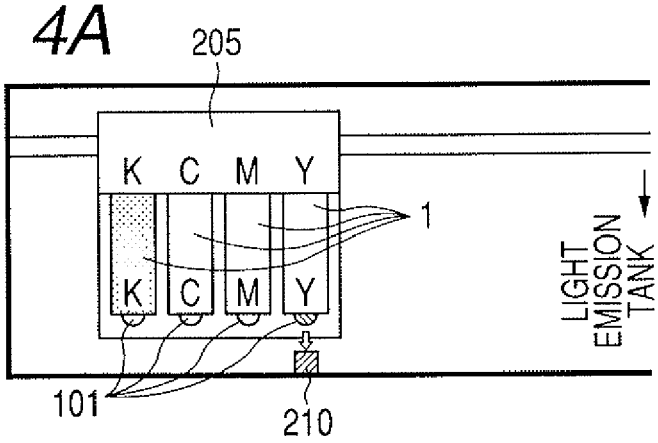
FIGS. 4A, 4B, 4C and 4D are schematic views showing the position detecting procedure according to the first embodiment of the present invention.
Figure 4B:
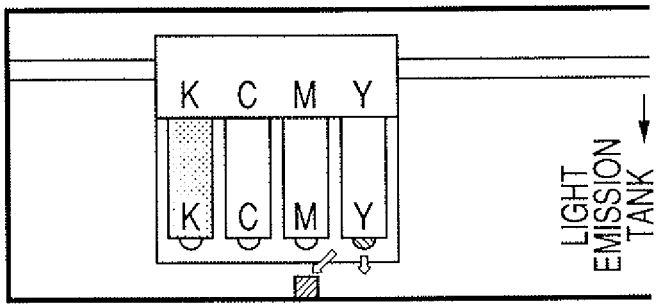
Figure 4C:
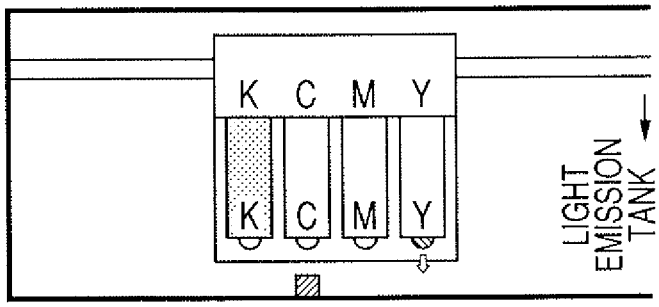
Figure 4D:
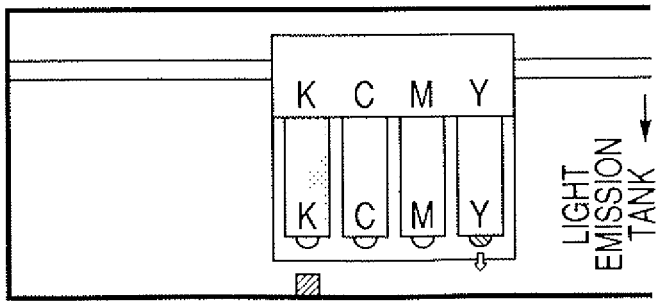

Next, FIG. 1C shows a state in which the carriage 205 has been further moved to the left by a distance corresponding to an ink tank 1, and the light receiving portion 210 faces the magenta ink tank 1M. In this case, the amount of light received by the light receiving portion 210 is 28 mV. Lastly, FIG. 1D shows a position in which the light receiving portion 210 faces the yellow ink tank 1Y, and the amount of light received by the light receiving portion 210 in this case is 3 mV.

FIGS. 2A to 4D are schematic views showing a case where the above-described operation has been sequentially performed in a state in which the LED 101 of the cyan ink tank 1C has been turned on, a state in which the LED 101 of the magenta ink tank 1M has been turned on, and a state in which the LED 101 of the yellow ink tank 1Y has been turned on.

Tables in the figures show the relationship between the lighted ink tank and the amount of light received by the light receiver at the respective ink tank positions. Even when the same current is passed by the same circuit, the amount of emitted light varies among a plurality of LEDs of the ink tanks because of manufacturing error. Consequently, this sometimes leads to variations among the LEDs 101 attached to the ink tanks 1. Further, the light guide characteristic varies among the light guides of the ink tanks because of manufacturing error, and the amount of light guided in the light guides is sometimes reduced. In addition, soil, such as ink mist, sticks to the ink tanks 1 because of differences in replacement frequency of the ink tanks 1, and this sometimes reduces the amount of emitted light. For this reason, the amount of emitted light sometimes varies among the ink tanks 1.

In the tables of the present exemplary embodiment for example, when the black ink tank 1K is turned on and placed at a position such as to face the light receiver 210, the amount of light received by the light receiver 210 is 563 mV. In contrast, when the cyan ink tank 1C is turned on and placed at a position such as to face the light receiver 210, the amount of received light is 62 mV, which is about one-ninth of the amount of light in the above case.

A method for checking the positions of the ink tanks 1 will now be described. Data corresponding to the tables shown in the above referenced figures are stored in the memory of the inkjet printer 200, and the positions are checked on the basis of the data. First, the position of the black ink tank 1K is checked. The position, where the largest amount of light is received by the light receiving portion 210 when the LED 101 of the black ink tank 1K is turned on is found. The amount of light at the black position K is 563 mV, which is the largest. Therefore, it is determined that the black ink tank 1K is mounted at the black position K. In this way, when the color of the lighted ink tank coincides with the color of the position in the carriage 205 where the amount of received light is the largest, it is determined that the ink tank is mounted at a correct position. Likewise, by looking for a maximum value with respect to each color, it can be determined that the cyan ink tank, the magenta ink tank and the yellow ink tank are mounted at a cyan position, a magenta position and a yellow position, respectively.

Next, a method for checking the ink tanks 1 that are mounted at wrong positions will be described. FIGS. 5A to 8D are schematic views showing the position detecting procedure when in the position detecting procedure described with reference to FIGS. 1A to 4D, mounting positions of the cyan ink tank 1C and the magenta ink tank 1M are reversed. That is, the cyan ink tank 1C is mounted at the magenta position M and the magenta ink tank 1M is mounted at the cyan position C. The steps shown in FIG. 5A to FIG. 8D are performed sequentially.

Figure 5A:
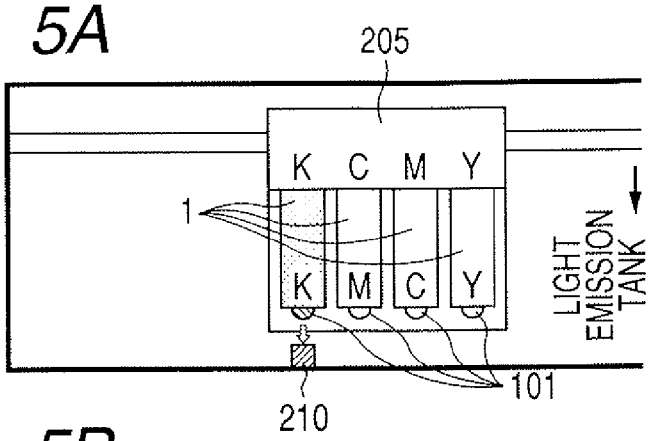
FIGS. 5A, 5B, 5C and 5D are schematic views showing the position detecting procedure according to the first embodiment of the present invention.
Figure 5B:
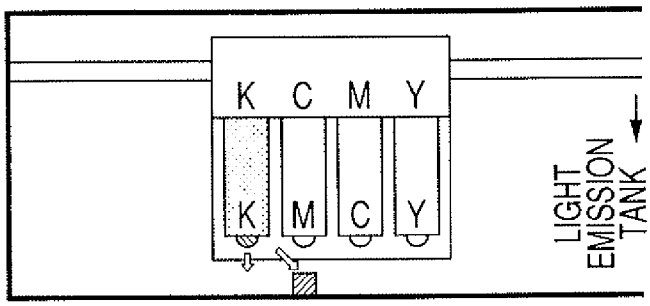
Figure 5C:
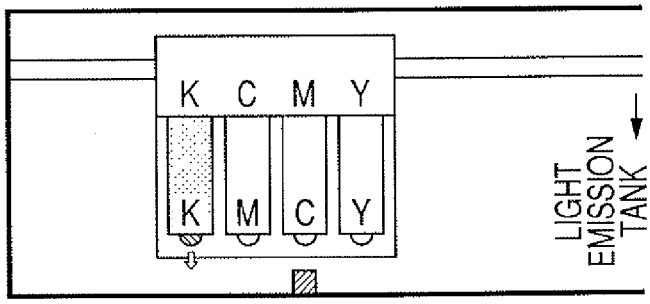
Figure 5D:
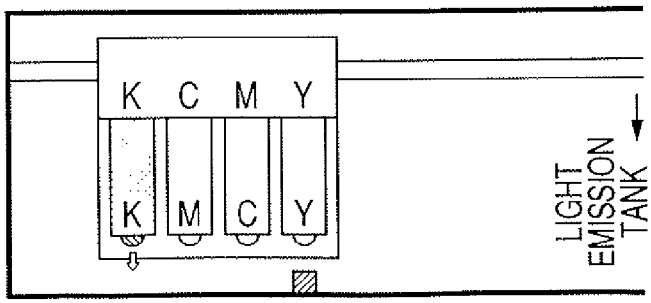

In FIGS. 5A to 5D, the LED 101 of the black ink tank 1K is first turned on. In FIG. 5A, the black ink tank 1K faces the light receiver 210, and the amount of light received by the light receiver 210 is about 563 mV. In the state shown in FIG. 5B, the carriage 205 is moved to the left along the guide shaft 207 by a distance corresponding to one ink tank, and the light receiver 201 faces the magenta ink tank 1M mounted at the cyan position C. In this case, since the LED 101 of the black ink tank 1K is turned on, the amount of light that reaches the light receiving portion 210 is 110 mV, which is smaller than when the light receiving portion 210 and the black ink tank 1K face each other. Next, FIG. 5C shows a state in which the carriage is further moved to the left by a distance corresponding to one ink tank 1, and the light receiving portion 210 faces the cyan ink tank 1C mounted at the magenta position M. In this case, the amount of light received by the light receiving portion 210 is 28 mV. Lastly, FIG. 5D shows a position in which the light receiving portion 210 faces the yellow ink tank 1Y mounted in the yellow position Y, and the amount of light received by the light receiving portion 210 in this case is 3 mV.

Figure 6A:
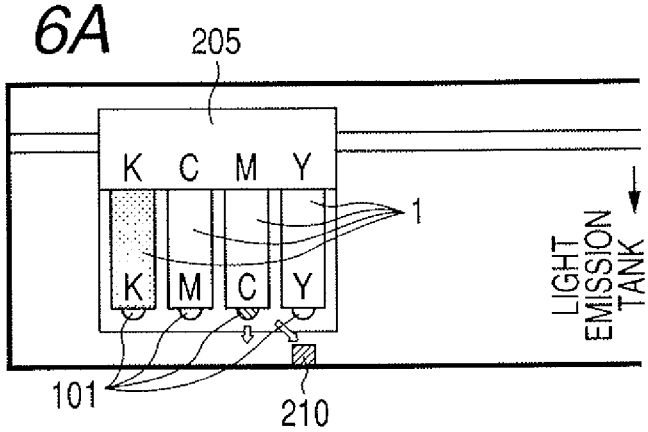
FIGS. 6A, 6B, 6C and 6D are schematic views showing the position detecting procedure according to the first embodiment of the present invention.
Figure 6B:
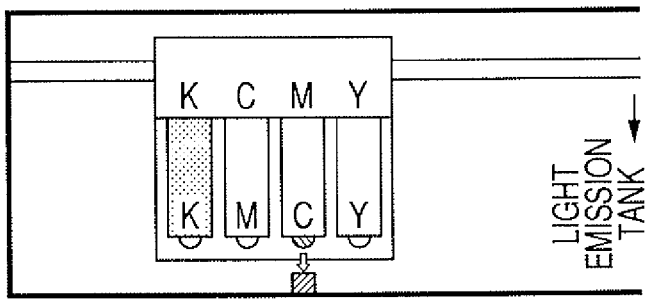
Figure 6C:
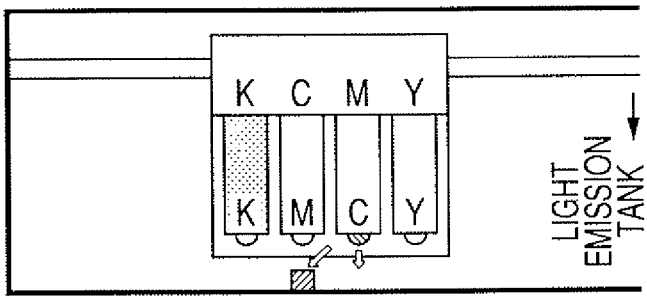
Figure 6D:
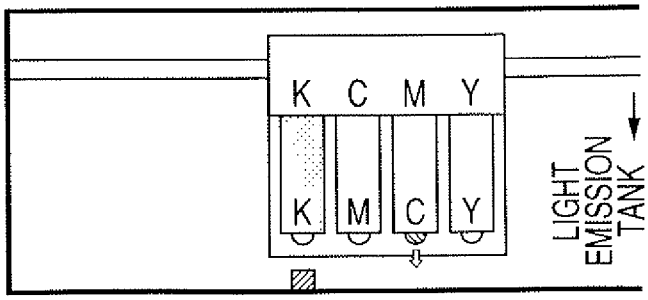

In FIGS. 6A to 6D, the LED 101 of the cyan ink tank 1C is turned on. FIG. 6A shows a position in which the light receiving portion 210 faces the yellow ink tank 1Y, and the amount of light received by the light receiving portion 210 in this case is 13 mV. Next, FIG. 6B shows a state in which the carriage 205 has been moved to the right along the guide shaft 207 by a distance corresponding to one ink tank 1, and the light receiving portion 210 faces the cyan ink tank 1C mounted at the magenta position M. In this case, the amount of light received by the light receiving portion 210 is 62 mV. Next, FIG. 6C shows a state in which the carriage 205 has been further moved to the right by a distance corresponding to one ink tank 1, and the light receiving portion 210 faces the magenta ink tank 1M mounted at the cyan position C. In this case, the amount of light received by the light receiving portion 210 is 14 mV. Lastly, FIG. 6D shows a position in which the light receiving portion 210 faces the black ink tank 1K mounted in the black position K. The amount of light received by the light receiving portion 210 in this case is 1 mV.

Figure 7A:
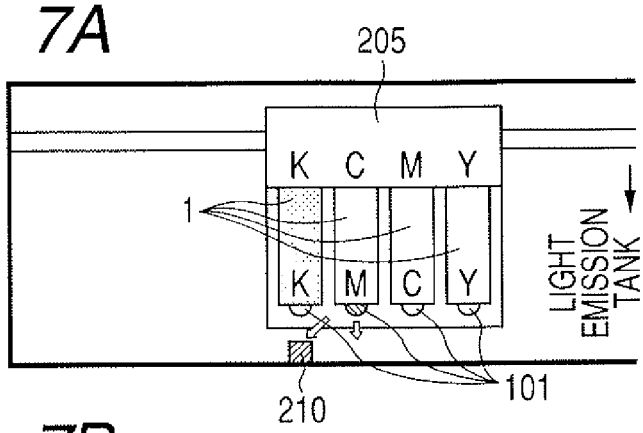
FIGS. 7A, 7B, 7C and 7D are schematic views showing the position detecting procedure according to the first embodiment of the present invention.
Figure 7B:
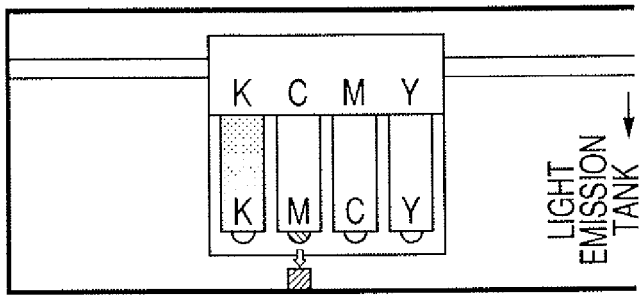
Figure 7C:
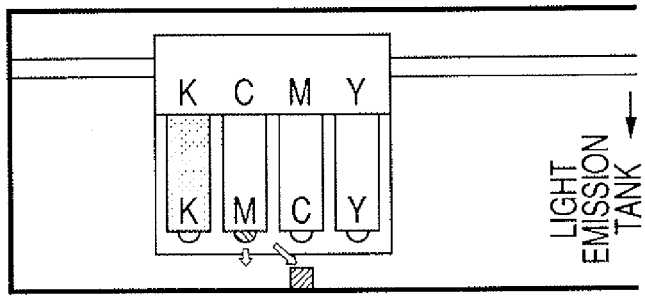
Figure 7D:
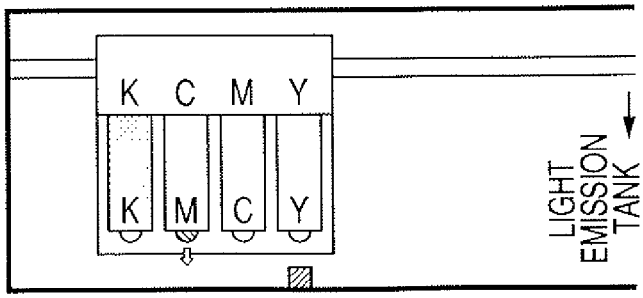
Figure 8A:
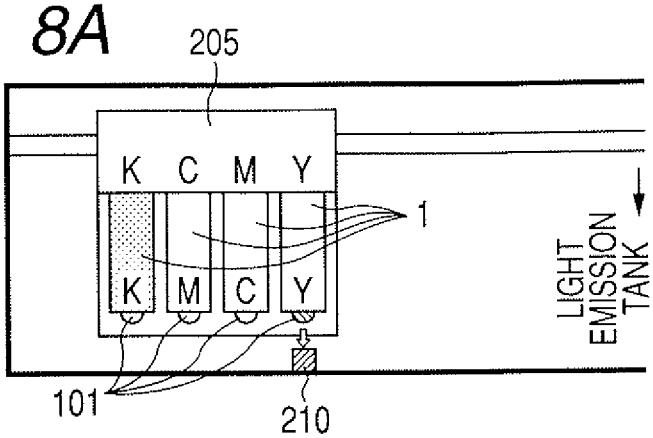
FIGS. 8A, 8B, 8C and 8D are schematic views showing the position detecting procedure according to the first embodiment of the present invention.
Figure 8B:
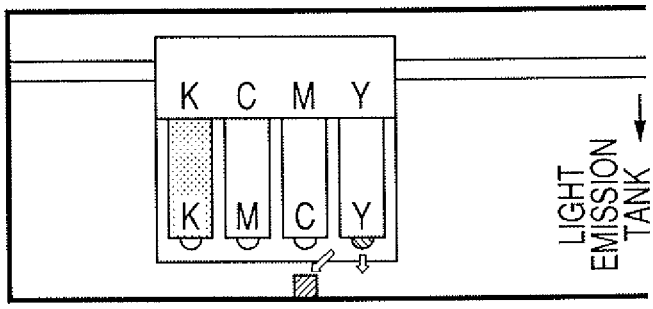
Figure 8C:
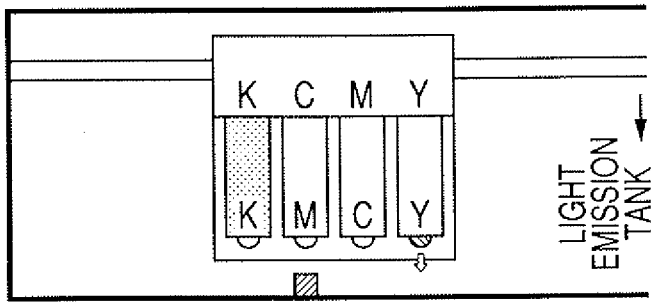
Figure 8D:
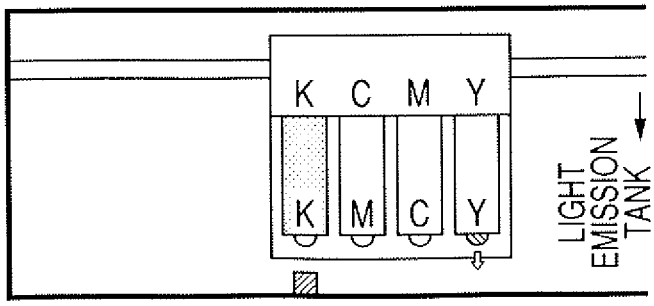

In FIGS. 7A to 7D, the LED 101 of the magenta ink tank 1M is turned on. FIG. 7A shows a position in which the light receiving portion 210 faces the black ink tank 1K and the amount of light received by the light receiving portion 210 in this case is 67 mV. Next, FIG. 7B shows a state in which the carriage 205 is moved to the left along the guide shaft 207 by a distance corresponding to one ink tank 1, and the light receiving portion 210 faces the magenta ink tank 1M mounted at the cyan position. In this case, the amount of light received by the light receiving portion 210 is 323 mV. Next, FIG. 7C shows a state in which the carriage 205 has been further moved to the left by a distance corresponding to one ink tank 1, and the light receiving portion 210 faces the cyan ink tank 1C mounted at the magenta position M. In this case, the amount of light received by the light receiving portion 210 is 68 mV. Lastly, FIG. 7D shows a position in which the light receiving portion 210 faces the yellow ink tank 1Y mounted at the yellow position Y, and the amount of light received by the light receiving portion 210 in this case is 3 mV.

The steps of FIGS. 8A to 8D are similarly performed to acquire data on the amount of received light. Then, the positions of the ink tanks 1 are checked.

First, the position of the black ink tank 1K is checked. The position, where the largest amount of light is received by the light receiver 210 when the LED 101 of the black ink tank 1K is turned on, is found. The amount of received light is 563 mV, that is, the largest at the black position K. Therefore, it is determined that the black ink tank 1K is mounted at the black position K. Similarly, the position, where the largest amount of light is received the light receiving portion 210 when the LED 101 of the cyan ink tank 1C is turned on, is found. The amount of light received by the light receiving portion 210 is 62 mV, that is, the largest at the magenta position M. Therefore, it is determined that the cyan ink tank 1C is incorrectly mounted at the magenta position M.

When the LED 101 of the magenta ink tank 1M is turned on, the amount of light received by the light receiving portion 210 is 323 mV, that is, the largest at the cyan position C. Finally, when the LED 101 of the yellow ink tank 1Y is turned on, the amount of light received by the light receiving portion 210 is 663 mV, that is, the largest at the yellow position Y. Thus, it can be determined that the black ink tank 1K and the yellow ink tank 1Y are correctly mounted, and the magenta ink tank 1M and the cyan ink tank 1C are incorrectly mounted.

A description will now be provided of a position detecting procedure when there is the influence of extraneous light. When the inkjet printer 200 is covered with the main body cover 201, any extraneous light is blocked from reaching the light receiving portion 210. However, depending on the environment where the inkjet printer 200 is used, extraneous light may enter from the ASF side or the sheet discharge tray 203 side. If this occurs, even though the LED 101 of the ink tank 1 is not turned on, the light receiving portion 210 detects the presence of light. This may result in the undesirable effect that the magnitude of the amount of light emitted by each ink tank 1 may be changed by the influence of the extraneous light, which may cause an incorrect detection. Therefore, the influence of the extraneous light is excluded by a method which is described below.

First, with the LED's 101 of the ink tanks 1 all turned off, the carriage 205 is moved along the guide shaft 207. At that time, the amount of light received by the light receiving portion 210 at each position is recorded (stored) in the memory as an amount of background light. When the LED 101 of each ink tank 101 is turned on in a state where extraneous light has entered the light receiving portion 210, the amount of light received by the light receiving portion 210 becomes a combination of the extraneous light plus the light of the LED 101.

When the amount of the extraneous light is the amount of background light, the amount of background light is subtracted from the amount of light received by the light receiving portion 210 during the above described position detection of the ink tanks 1. Thus it becomes possible to exclude the influence of the extraneous light, and stable position detection of the ink tanks 1 can be achieved. When the extraneous light is greater than the light typically emitted from the LEDs 101, the background value is large, and the extraneous light plus the amount of light emitted by the LED 101 exceeds a reference voltage of 3300 mV and becomes saturated. That is, the value obtained by subtracting the amount of background light does not exhibit the amount of light emitted from the LED, and there is the possibility of incorrect detection. Therefore, when the background value exceeds a set value, error processing is carried out so that position detection may not take place.

In the present embodiment, the LED's 101 of the respective ink tanks 1 are successively made to emit light one by one in order to detect the position of the ink tank 1 which emitted light, whereafter the LED 101 of the next ink tank 1 is made to emit light to thereby achieve the position detection of that ink tank 1 which has emitted light.

Further, detecting the amount of light emitted by each of the ink tanks 1 at the multiple positions enables determination of not only whether an ink tank 1 has been incorrectly mounted, but which ink tank 1 has been incorrectly mounted. In an embodiment where the inkjet printer 200 has a display, it is possible for a user to view the results of the above-described detection procedures. In addition, if the inkjet printer 200 and a personal computer (not shown) are connected, the results of the detection can be viewed on the personal computer's display. Displaying the results of the detection enables a user to easily solve the problem when ink tanks 1 are incorrectly mounted.

Second Embodiment

A position checking method, using ink tanks and a printer similar to those in the first embodiment, will now be described with reference to FIGS. 9A to 16B.

FIGS. 9A to 12B are schematic views showing the position checking procedure when the ink tanks 1 are correctly mounted, where the procedure is performed sequentially from FIG. 9A to FIG. 12B. FIGS. 13A to 16B are schematic views showing the position checking procedure when mounting positions of the cyan ink tank 1C and the magenta ink tank 1M are reversed. That is, the cyan ink tank 1C is mounted at the magenta position M and the magenta ink tank 1M is mounted at the cyan position C. The procedure is performed sequentially from FIG. 13A to FIG. 16B.

Also, as in the first embodiment, the following operation is controlled by the control circuit 300.

Figure 9A:
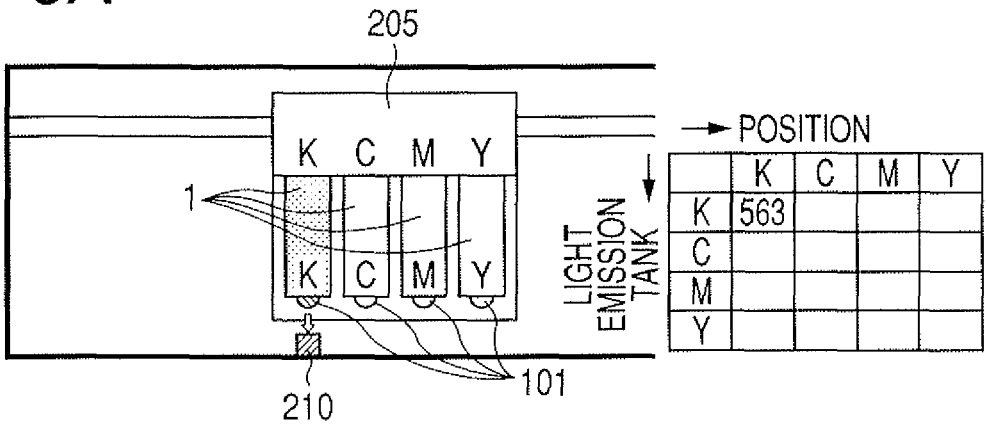
FIGS. 9A and 9B are schematic views showing a position detecting procedure according to a second embodiment of the present invention.
Figure 9B:
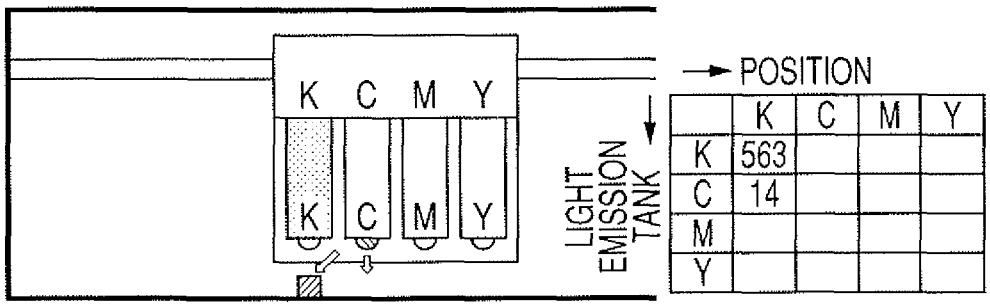

FIGS. 9A and 9B show a state in which the carriage 205 has been moved so that the light receiving portion 210 faces a black position K. FIG. 9A shows a state in which the LED 101 of the black ink tank 1K is turned on, and the amount of light received by the light receiving portion 210 is 563 mV. FIG. 9B shows a state in which the LED 101 of the black ink 1K tank is turned off and the LED 101 of the cyan ink tank 1C is turned on. In this case, the amount of light received by the light receiving portion 210 is 14 mV.

Figure 10A:
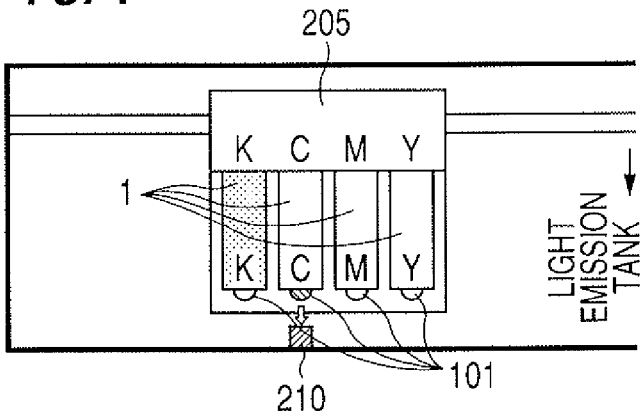
FIGS. 10A, 10B and 10C are schematic views showing the position detecting procedure according to the second embodiment of the present invention.
Figure 10B:
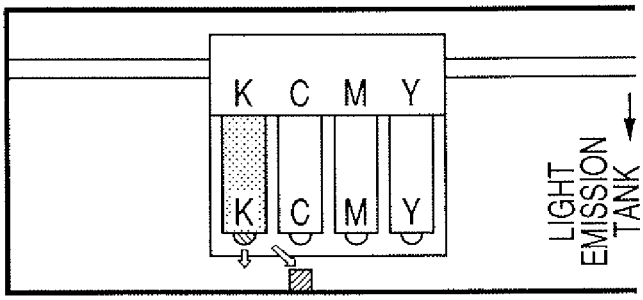
Figure 10C:
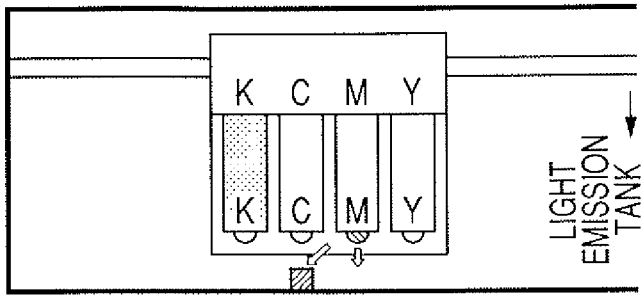

FIGS. 10A and 10B show states in which the carriage 205 is moved to the left by a distance corresponding to one ink tank 1, that is, the light receiving portion 210 faces the cyan position C. In the state shown in FIG. 1A, the carriage 205 is moved without turning off the LED 101 of the cyan ink tank 1C that has been turned on in FIG. 9B. In this case, the amount of light received by the light receiving portion 210 62 mV. In the state shown in FIG. 10B, the carriage 205 is not moved, the LED 101 of the cyan ink tank 1C is turned off, and the LED 101 of the black ink tank 1K is turned on. In this case, the amount of light received by the light receiving portion 210 is 110 mV. In the state shown in FIG. 10C, the LED 101 of the black ink tank 1K is turned off, and an LED 101 of the magenta ink tank 1M is turned on. In this case, the amount of light received by the light receiving portion 210 at this time is 67 mV.

In FIGS. 11A to 12B, the carriage 205 is moved to the left by a distance corresponding to one ink tank 1, and the LEDs 101 of the adjacent ink tanks are alternately turned on. Consequently, the amount of light received by the light receiving portion 210 placed in front of the ink tank 1 mounted at a proper position and the amounts of received light obtained at the positions on both sides (only one position on the outermost side) are stored as data in the memory of the inkjet printer 200. The mounting positions of the ink tanks are checked on the basis of the data.

Figure 11A:
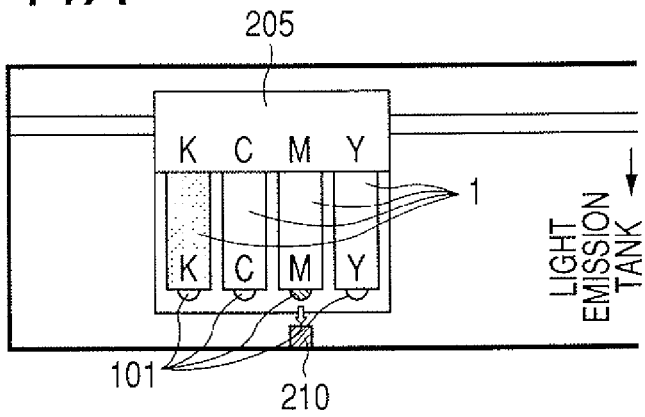
FIGS. 11A, 11B and 11C are schematic views showing the position detecting procedure according to the second embodiment of the present invention.
Figure 11B:
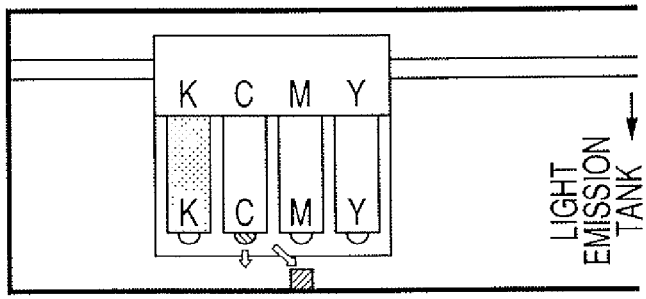
Figure 11C:
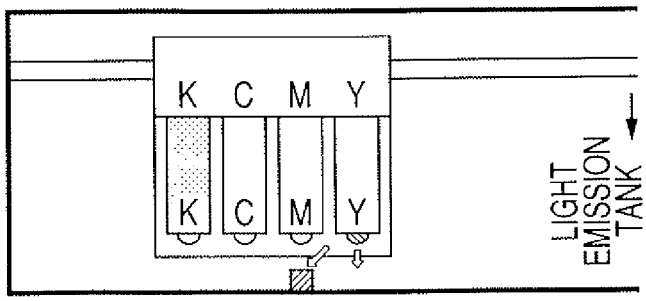
Figure 12A:
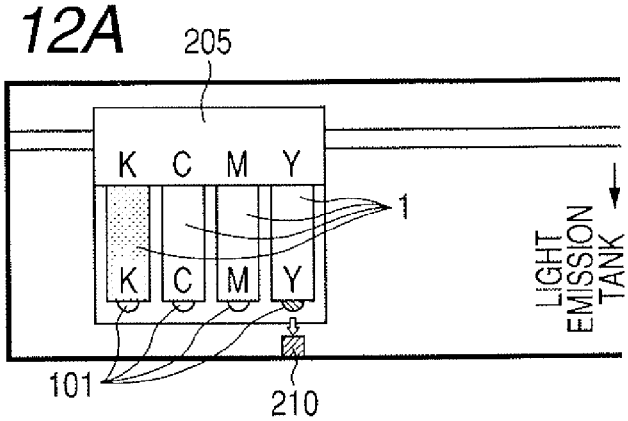
FIGS. 12A and 12B are schematic views showing the position detecting procedure according to the second embodiment of the present invention.
Figure 12B:
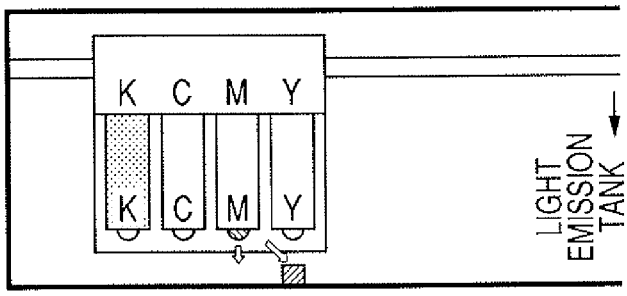

According to the tables in FIGS. 11A to 12 obtained by the above-described procedure, for example, the mounting position of the magenta ink tank 1M is checked. When the LED 101 of the magenta ink tank 1M is turned on, the amount of light received is 323 mV when the light receiving portion 210 faces the magenta position M. When the magenta ink tank 1M is moved to the cyan position C, the amount of light received is 67 mV when the light receiving portion 210 faces the cyan position C. When the magenta ink tank 1M is moved to the yellow position Y, the amount of light received by the light receiving portion 210 is 68 mV. By comparing these values, it is found that the amount of received light is the largest at the magenta position M. Therefore, it is determined that the magenta ink tank 1M is mounted properly.

When the ink tank 1 is mounted at a proper position in this way, the amount of received light at the proper position is larger than the amounts of received light at the positions on both sides of the proper position (only one position on the outermost side), that is, the amount of received light at the proper position is the largest. From this, it can be determined that the ink tank 1 is mounted properly.

A description will now be given a position checking procedure performed when the cyan ink tank 1C and the magenta ink tank 1M are reversed, that is, the cyan ink tank 1C has been mounted at the magenta position M and the magenta ink tank 1M has been mounted at the cyan position C.

Figure 13A:
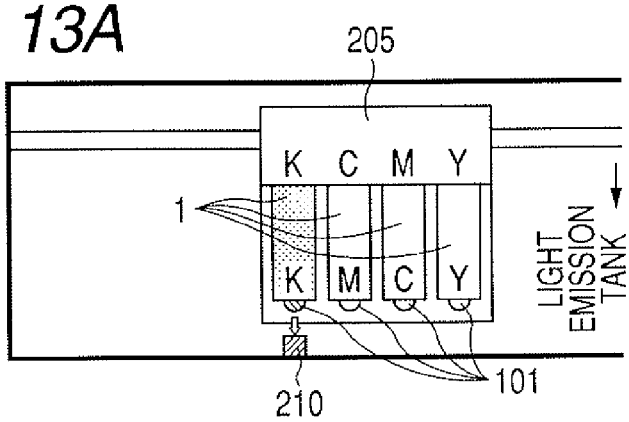
FIGS. 13A and 13B are schematic views showing the position detecting procedure according to the second embodiment of the present invention.
Figure 13B:
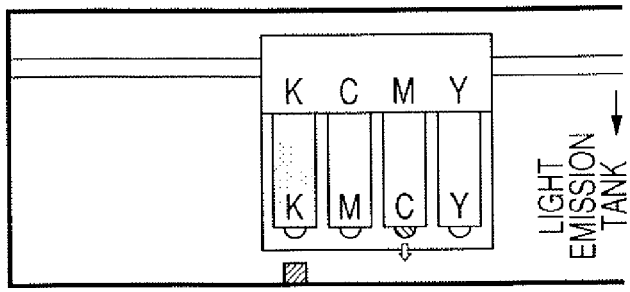

FIGS. 13A and 13B show states in which the carriage 205 is moved so that the light receiving portion 210 faces the black position K. FIG. 13A shows a state in which the LED 101 of the black ink tank 1K is turned on, and the amount of light received by the light receiving portion 210 is 563 mV. FIG. 13B shows a state in which the LED 101 of the black ink tank 1K is turned off and the LED 101 of the cyan ink tank 1C is turned on. However, the cyan ink tank 1C is mounted at the magenta position M, and therefore, the amount of light received by the light receiving portion 210 is 1 mV, which is lower than the 14 mV received when the cyan ink tank 1C is mounted at the cyan position C.

Figure 14A:
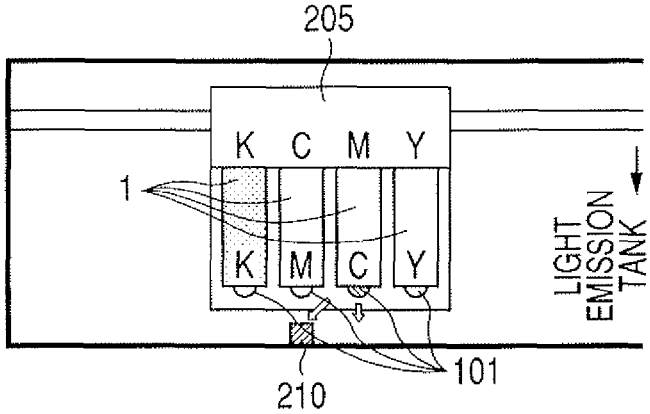
FIGS. 14A, 14B and 14C are schematic views showing the position detecting procedure according to the second embodiment of the present invention.
Figure 14B:
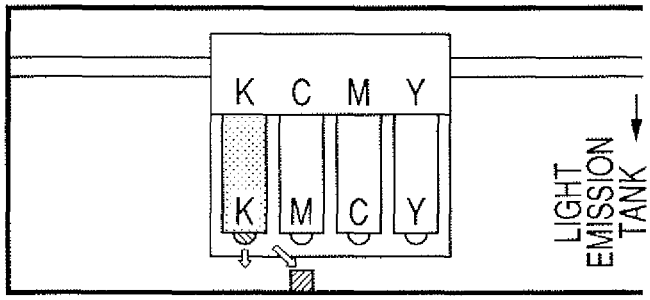
Figure 14C:
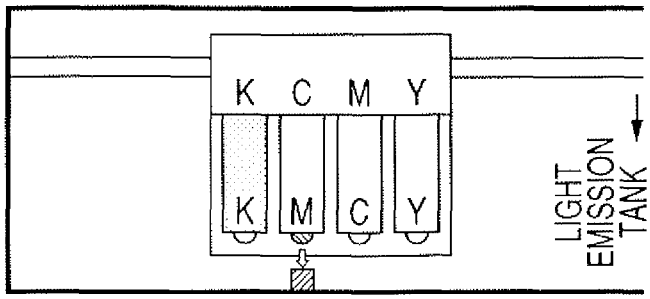
Figure 15A:
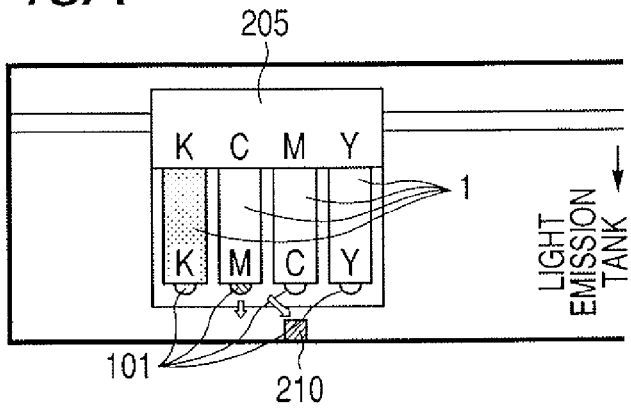
FIGS. 15A, 15B and 15C are schematic views showing the position detecting procedure according to the second embodiment of the present invention.
Figure 15B:
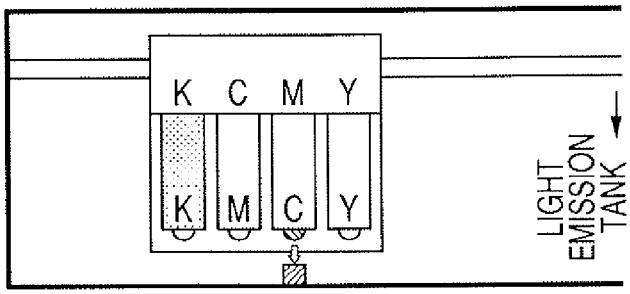
Figure 15C:
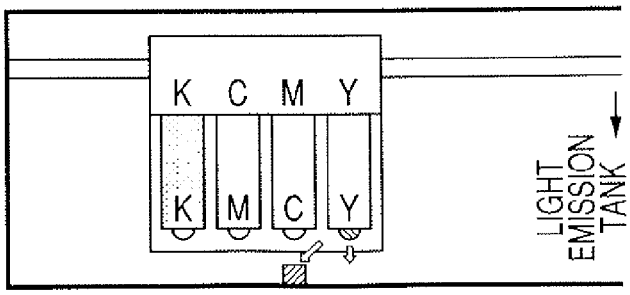
Figure 16A:
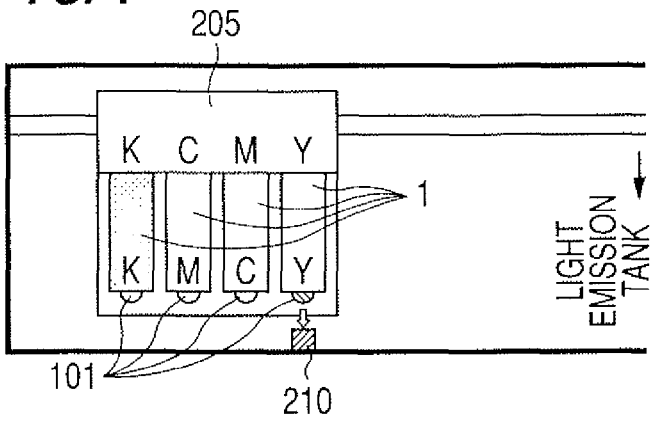
FIGS. 16A and 16B are schematic views showing the position detecting procedure according to the second embodiment of the present invention.
Figure 16B:
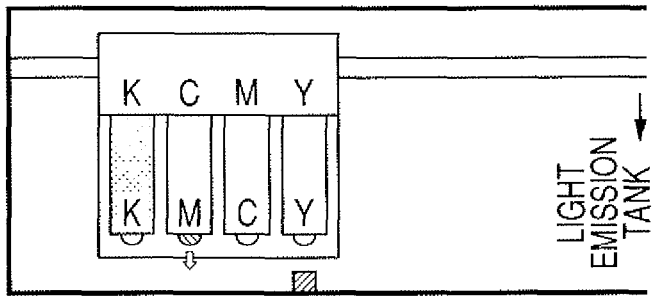

Next, FIGS. 14A to 14C show states in which the carriage 205 is moved to the left by a distance corresponding to one ink tank 1, that is, the light receiving portion 210 faces the cyan position C. FIG. 14A shows a state in which the carriage 205 is without turning off the LED 101 of the cyan ink tank 1C that was turned on in FIG. 13B, and therefore, the LED 101 of the cyan ink tank 1C remains lighted. However, the cyan ink tank 1C is mounted at the magenta position M, and therefore, the 14 mV received by the light receiving portion 210 is lower than the 62 mV received when the cyan ink tank 1C is mounted at the cyan position C.

FIG. 14B shows a state in which LED 101 of the cyan ink tank 1C is turned off and the LED 101 of the black ink tank 1K is turned on. FIG. 14C shows a state in which the LED 101 of the black ink tank 1K is turned off and the LED 101 of the magenta ink tank 1M is turned on.

In FIGS. 15A to 16B, the carriage 205 is moved to the left by a distance corresponding to one ink tank 1, and the LEDs 101 of the adjacent ink tanks are alternately turned on. Consequently, according to the above-described procedure, taking the magenta ink tank 1 as an example, in the tables in FIGS. 15A to 16B, the amount of light received at the light receiving portion 210 when the magenta ink tank 1M mounted at the cyan position C faces the light receiving portion 210 is 323 mV. When the carriage 205 is moved to a position where the cyan ink tank 1C mounted at the magenta position M faces the light receiving portion 210, the amount of received light is 68 mV. When the carriage 205 is moved to a position where the yellow ink tank 1Y mounted at the yellow position Y faces the light receiving portion 210, the amount of received light is 8 mV. Since the maximum amount of light is not received when the magenta ink tank 1M is at the magenta position M, it is determined that the magenta ink tank 1M is incorrectly mounted.

When the ink tank 1 is incorrectly mounted, the amount of light received at the incorrect position is less than the amounts of light received light at the positions on both sides of the correct position (only one position on the outermost side). Thus, when the amount of light received in the central position is not the maximum amount, it can be determined that the ink tank 1 is improperly mounted.

Like the first embodiment, the second embodiment also includes a position detecting procedure when there is the influence of extraneous light. Since the procedure in the present embodiment is identical to that previously described, a detailed description is omitted herein.

In the present embodiment, the positions of all the ink tanks can be checked only during the movement of the carriage 205 in one direction. This can reduce the time from when the ink tank is replaced to when the printer is restarted.

While the position checking method for the printer in which four ink tanks corresponding to four colors are mounted have been described in the first and second embodiments, the number of colors is not limited to four. The above-described position checking method is also applicable to a printer in which ink tanks corresponding to five or more colors are mounted.

As described above, in the first and second embodiments, the light emitted by the LEDs 101 of adjacent ink tanks 1 can be used to determine whether ink tanks 1 are correctly mounted.

According to the above-described exemplary embodiments, a determination is made whether ink tanks 1 are correctly mounted by sequentially turning on the LEDs 101 of the respective ink tanks 1 at predetermined positions in accordance with the movement of the carriage 205, resulting in detection of the light emitted by the LEDs 101.

Further, as described in the above exemplary embodiments, in a case where there is some unevenness in the amount of light received by the light receiving portion 210, a determination can still be made whether the ink tanks 1 are correctly mounted.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2005-180555 filed Jun. 21, 2005, which is hereby incorporated by reference herein.

What is claimed is:

1. A recording apparatus comprising:

an ink tank having a light emitter;

a movable carriage having a plurality of mounting portions to which the ink tank is detachably mountable, wherein the mounting portions are arranged in a moving direction of the carriage and include at least a first mounting portion corresponding to the ink tank and a second mounting portion not corresponding to the ink tank;

a light receiving unit capable of receiving light emitted from the light emitter; and a determining unit for determining whether the ink tank is mounted to the first mounting portion, on the basis of at least a first light receiving amount of the light receiving unit provided by light emitted from the light emitter when the first mounting portion faces the light receiving unit and a second light receiving amount of the light receiving unit provided by light emitted from the light emitter when the second mounting portion faces the light receiving unit.

2. A recording apparatus according to claim 1, further comprising:

a plurality of ink tanks including the ink tank and other ink tanks different from the ink tank, a common electrical line configured to commonly electrically connect to the plurality of ink tanks mounted to the plurality of mounting portions.

3. A recording apparatus according to claim 2, wherein the light emitter is turned on in accordance with a light emitting command sent from the common electrical line.

4. A recording apparatus according to claim 1, further comprising:

a plurality of ink tanks including the ink tank and other ink tanks different from the ink tank, the other ink tanks each having light emitters;

a memory for storing background light amount of the light receiving unit when all of the light emitters of the plurality of ink tanks mounted in the carriage are turned off at a position where the first mounting portion faces the light receiving unit, wherein the determining unit determines whether the ink tank is mounted to the first mounting portion on the basis of the background light amount stored in the memory.

5. A recording apparatus according to claim 1:

wherein the second mounting portion is adjacent to the first mounting portion.

6. A recording apparatus according to claim 1, wherein the plurality of mounting portions further includes a third mounting portion not corresponding to the ink tank, and the second and third mounting portions are at both adjacent sides of the first mounting portion, and wherein the determining unit determines whether the ink tank is mounted to the first mounting portion, on the basis of a third light receiving amount of the light receiving unit provided by light emitted from the light emitter when the first mounting portion faces the light receiving unit.

7. A determining method in a recording apparatus, the recording apparatus comprising a movable carriage having a plurality of mounting portions to which an ink tank having a light emitter is detachably mountable, the plurality of mounting portions being arranged in a moving direction of the carriage and having at least a first mounting portion corresponding to the ink tank and a second mounting portion not corresponding to the ink tank, and a light receiving unit capable of receiving light emitted from the light emitter, the method including:

detecting a first light receiving amount of the light receiving unit provided by light emitted from the light emitter when the first mounting portion faces the light receiving unit;

detecting a second light receiving amount of the light receiving unit provided by light emitted from the light emitter when the second mounting portion faces the light receiving unit; and determining whether the ink tank is mounted to the first mounting portion on the basis of the first light receiving amount and the second light receiving amount.

8. A determining method according to claim 7, wherein the second mounting portion is adjacent to the first mounting portion.

9. A recording apparatus comprising:

a plurality of ink tanks each having a light emitting unit, the plurality of ink tanks having at least a first ink tank containing a first color ink and a second ink tank containing a second color ink;

a movable carriage having a plurality of mounting portions respectively corresponding to the plurality of ink tanks, the plurality of mounting portions being arranged in a moving direction of the carriage and including at least a first mounting portion corresponding to the first ink tank and a second mounting portion corresponding to the second ink tank;

a light receiving unit capable of receiving light emitted from the light emitter of the plurality of ink tanks; and a determining unit for determining whether the first ink tank is mounted to the first mounting portion and for determining whether the second ink tank is mounted to the second mounting portion, wherein the determining unit determines whether the first ink tank is mounted to the first mounting portion, on the basis of at least a first light receiving amount received by the light receiving unit when the light emitter of the first ink tank emits light at a first position where the first mounting portion faces the light receiving unit and a second light receiving amount received by the light receiving unit when the light emitter of the first ink tank emits light at a second position where the second mounting portion faces the light receiving unit, and wherein the determining unit determines whether the second ink tank is mounted to the second mounting portion, on the basis of at least a third light receiving amount received by the light receiving unit when the light emitter of the second ink tank emits light at the first position and a forth light receiving amount received by the light receiving unit when the light emitter of the second ink tank emits light at the second position.

10. A recording apparatus according to claim 9, further comprising a common electrical line configured to commonly electrically connect to the plurality of ink tanks mounted to the plurality of mounting portions.

11. A recording apparatus according to claim 10, wherein the light emitters of the first ink tank is turned on in accordance with a first light emitting command sent from the common electrical line, wherein the light emitters of the second ink tank is turned on in accordance with a second light emitting command sent from the common electrical line.

12. A recording apparatus according to claim 9, further comprising a memory for storing a first background light amount received by the light receiving unit when all of the light emitters of the plurality of ink tanks mounted in the carriage are turned off at a first position where the first mounting portion faces the light receiving unit and a second background light amount received by the light receiving unit when all of the light emitters of the plurality of ink tanks mounted in the carriage are turned off at a second position where the second mounting portion faces the light receiving unit, wherein the determining unit determines whether the first ink tank is mounted to the first mounting portion on the basis of the first background light amount stored in the memory and, wherein the determining unit determines whether the second ink tank is mounted to the second mounting portion on the basis of the second background light amount stored in the memory.

13. A recording apparatus according to claim 12, wherein the second mounting portion is adjacent to the first mounting portion.

* * * * *